US007124699B1

(12) United States Patent
Clark et al.

(10) Patent No.: US 7,124,699 B1
(45) Date of Patent: Oct. 24, 2006

(54) PORTABLE DOCK CLEAT

(76) Inventors: Terry Swann Clark, 4324 Golf Club La., Tampa, FL (US) 33618; Beth Engelman Clark, 4324 Golf Club La., Tampa, FL (US) 33618

( * ) Notice: Subject to any disclaimer, the term of this patent is extended or adjusted under 35 U.S.C. 154(b) by 0 days.

(21) Appl. No.: 11/263,209

(22) Filed: Nov. 1, 2005

(51) Int. Cl.
*B63B 21/04* (2006.01)

(52) U.S. Cl. ..... 114/218

(58) Field of Classification Search ..... 114/218; D08/356, 382
See application file for complete search history.

(56) References Cited

U.S. PATENT DOCUMENTS 4,344,378 A * 8/1982 Martin ..... 114/218
5,018,471 A * 5/1991 Stevens ..... 405/211
5,542,367 A * 8/1996 DuBois et al. ..... 114/218
6,499,915 B1 * 12/2002 Tayman ..... 405/212
6,662,739 B1 * 12/2003 Radford ..... 114/218
6,840,186 B1 * 1/2005 Steele ..... 114/218
6,926,240 B1 * 8/2005 Goeller ..... 248/218.4
6,928,950 B1 * 8/2005 Trammell et al. ..... 114/382

* cited by examiner

*Primary Examiner*—Stephen Avila

(57) ABSTRACT

This invention was developed to provide a temporary and portable device for tying up a boat at a convenient and safe point of attachment on a dock structure, where no permanent point of attachment currently exists. It primarily comprises a strong, flexible strap that can be wrapped around a dock piling or other structure of similar circumference and held tightly in place by means of a cam-lock buckle and Velcro. A conventional dock cleat is bolted to this strap as a secure point of attachment for a boat docking line.

7 Claims, 8 Drawing Sheets

1

Arrows indicate
view of strap passing
through buckle
4
Inside Veiw of Buckle

Terry Clark & Beth Clark
(813)968-0453

PORTABLE DOCK CLEAT

CROSS-REFERENCE TO RELATED APPLICATIONS

Not Applicable

STATEMENT REGARDING FEDERALLY SPONSORED REASEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

In the course of a boating experience, whether for recreational or commercial purposes, it is often, and in some cases always, necessary to secure a boat to a dock, wharf, pier or other land connected structure when the boat is no longer in use or is to be left unattended. Many boats have a home dock or slip where the owner or operator has made permanent accommodations for conveniently and safely tying up the boat. However, in many cases where a boater finds it necessary or desirable to tie up at a temporary location, they will find that the dock cleats that they are required to tie to are located in the wrong place, too far away, too few or even non-existent. Thus, making it difficult and sometimes unsafe to secure the boat. And, while there are no design standards for marina and dock construction regarding location and number of dock cleats, the problem is compounded by the various sizes and shapes of boats and the placement of their deck mounted docking equipment. In some cases, dock cleats have not been installed in certain areas because they can be a trip hazard when walking. Thus, there are many considerations, variables and unknowns that can lead to difficulties in temporary boat docking situations.

Even in a marina that a boater has visited before and found to be safe and convenient for tying up his or her boat, they may now find that other transient boaters have taken their favorite docking location or otherwise crowded the docking facilities. And, unlike an automobile that can be left immobile in a parking space, a boat in a crowded marina must have some room for movement due to tides or currents. This makes the proper location of dock cleats even more critical to safely securing a boat and preventing damage to it and other boats while unattended.

Additionally, while a boat dock may have the dock cleats in a convenient location, other boats may already be tied to the cleats the boater needs and it may not be practical or appropriate to tie his or her dock lines over that of the previous boater.

Another problem encountered by boaters, which is again compounded by crowded marina facilities or the lack of conveniently placed dock cleats, is the need to adjust dock lines in the event the boat is docked in an area of tidal changes, during which time the water level will rise or fall. Adjusting the dock lines can be a time consuming process that must occur several times each day. This is especially true in situations where boaters are not able to adjust the dock lines at the attachment points to their boats, but must instead adjust the dock lines that they have wrapped and tied around a dock support piling due to the lack of conveniently located dock cleats.

A solution of course, is to mount any of the many available permanent mount dock cleats where a particular boat or boater needs them. This requires drilling holes in the dock material and mounting the dock cleats with screws or bolts. However, this is an impractical amount of labor for a short visit and inappropriate for anyone other than the owner of the dock structure. A more practical solution would be a strong, secure dock cleat that can be quickly attached to a strong and permanent component of the dock structure, placed where it is needed, and easily removed for future use at a different location.

BRIEF SUMMARY OF THE INVENTION

The present invention that is designed to solve the aforementioned boat docking problems consist of a conventional nylon boat dock cleat, commonly referred to in the industry as an open base cleat. This means that it has two feet for mounting to a secure surface and the typical saddle horns at each end to wrap dock line around.

The base of the dock cleat is mounted longitudinally to a two inch wide, strong and flexible strap of the type used for securing a boat to an over the road trailer. The strap, also having a cam-lock buckle attached to it on one end, by means of sewing. The dock cleat is secured by thru-bolting the cleat to the strap using two stainless steel bolts, six washers and two nuts. The strap and it's attached dock cleat are designed to be wrapped and secured around a strong dock support piling to more conveniently locate a secure attachment point for a boat dock line.

Once the strap is wrapped around the chosen dock piling at the desired height, the loose end of the strap is then threaded through the open cam-lock buckle and pulled through the buckle to tighten the strap around the dock piling. The cam-lock buckle is then closed by rotating it inward toward the surface of the dock piling and around the point of it's profile, locking it in place and further tightening the strap around the piling. In this same rotating motion of the cam-lock buckle, the end of the strap that exits the buckle moves toward and is pressed onto an adjacent section of the strap as it encircles the dock piling, and the two strap surfaces are then secured together by Velcro strips that have been sewn to the strap. This further ensures that the cam-lock buckle will stay closed and the portable dock cleat cannot be loosened without a two step process of pulling the Velcro strips apart and rotating the cam-lock buckle out and away from the dock piling. When the cam-lock buckle is in the closed and locked position, the two bolts that are used to hold the dock cleat to the strap add further security as their threaded ends protrude slightly through the inside surface of the strap and dig into the wood surface of the dock piling when the strap is pulled tightly around the piling. This further prevents the portable dock cleat from moving laterally or vertically on the piling.

Upon securing the portable dock cleat to a convenient dock piling, the boater now has a better point for tying his or her dock line to a strong part of the dock structure. Yet, with the dock line still attached, it also allows the boater to quickly pull apart the Velcro strips and open the cam-lock buckle to loosen the portable dock cleat, and adjust it's vertical location on the dock piling for a rising or falling tide. And, a boater no longer has to deal with the mess and inconvenience of wrapping dock lines around a bare dock piling several times for a secure connection. As designed, the portable dock cleat can also be removed in seconds so that the boater may take it with him or her to use again when the need arises.

DETAILED DESCRIPTION OF THE INVENTION

Figure 1:
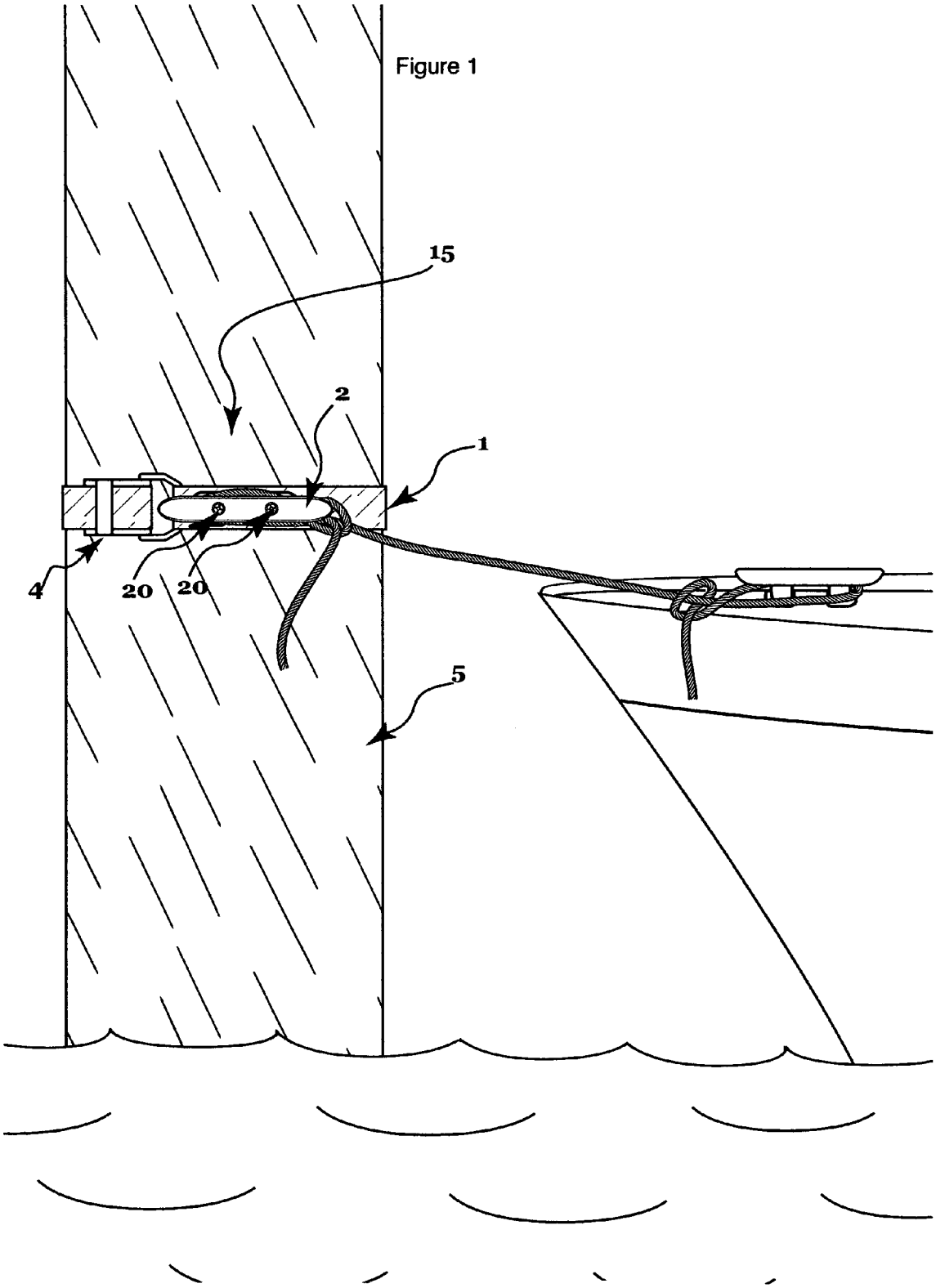
FIG. 1 illustrates the portable dock cleat as it is properly attached to a dock piling and in service for it's intended purpose.

The complete embodiment of the invention as it is properly secured on a dock piling and in service, is depicted in FIG. 1. The portable dock cleat (15) in it's present form is comprised of a flexible strap (1) to which a dock cleat (2) is bolted using two bolts (20) secured by washers and nuts. A cam-lock buckle (4) is sewn to the end of the strap nearest to the location of the dock cleat (2), the cam-lock buckle serving to secure the strap around a dock piling (5). Velcro in the form of a hook and loop fastening system, is attached to the strap by means of sewing, the Velcro serving to secure the loose end of the strap when it is installed around a dock piling (5).

To construct the portable dock cleat, a two inch wide strap of strong flexible material is used, such as the type utilized to tie boats down to over the road trailers. In this particular embodiment, a strap with a rated capacity of 1500 lbs. and working capacity of 500 lbs. is used. The strap must be cut to a length of 53" and melted on each end by a source of heat to ensure that the strap material will not unravel.

Figure 2:
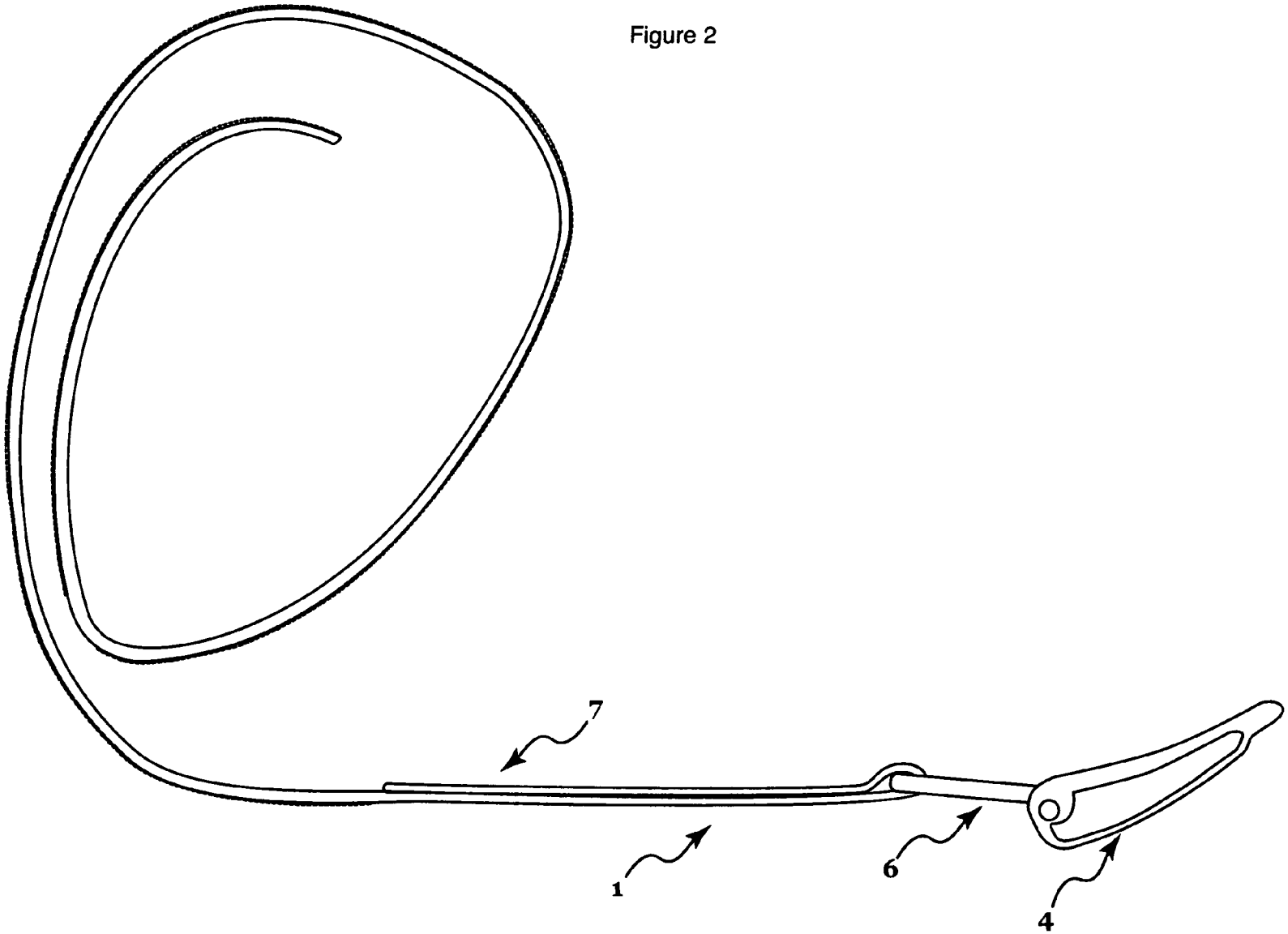
FIG. 2 illustrates the device under construction prior to the attachment of the dock cleat and depicts the proper orientation of the strap for wrapping the strap around the steel connector bar of the cam-lock buckle and sewing the overlapped section of the strap together to secure the connection of the strap to the cam-lock buckle.
Figure 3:
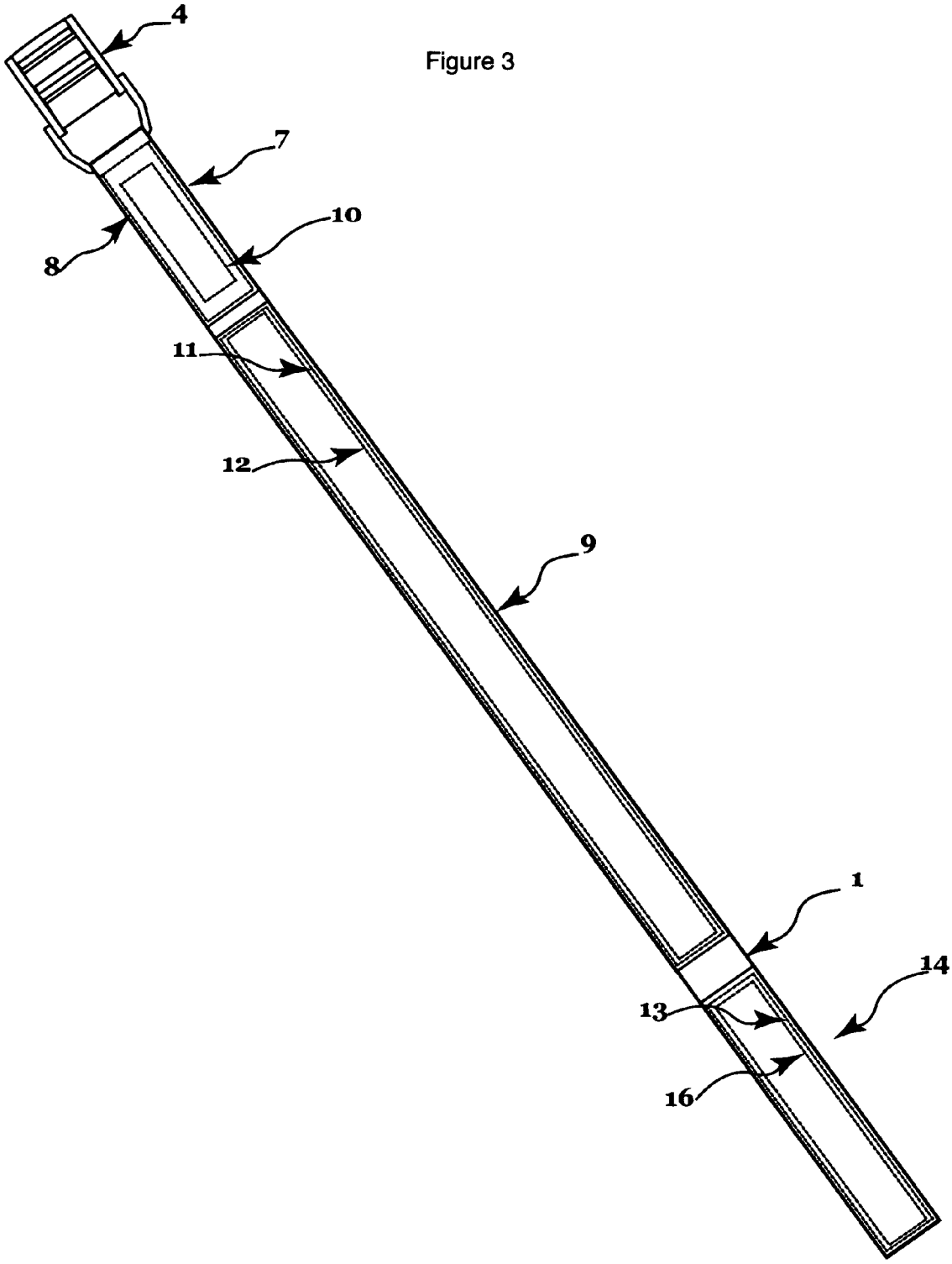
FIG. 3 illustrates the device under construction, with the open cam-lock buckle and full length of the strap prior to the attachment of the dock cleat. This view illustrates what would be the inside surface of the strap when it is secured around a dock piling and shows the sewing pattern that secures the Velcro materials to the other side of the strap.

With the strap cut to a length of 53", the cam-lock buckle is now sewn onto one end of the strap. To prepare the cam-lock buckle for attachment to the strap, the buckle should be fully extended as shown in FIG. 2 with the steel connector bar (6) of the cam-lock buckle (4) oriented toward the end of the strap (1). The cam-lock buckle should then be rested on a convenient surface for attachment of the strap with the convex profile side of the buckle down and the concave profile side up. Referring again to FIG. 2, it is illustrated how the strap (1) has been wrapped around the inside radius of the steel connector bar (6) of the cam-lock buckle (4) and the strap (1) is then overlapped onto itself for a length of 6¼", as measured from the point where the strap wraps around the inside radius of the steel connector bar (6). Using nylon thread, the overlapped section (7) of the strap (1) is now ready to be sewn together. Referring to FIG. 3, the sewing pattern used in this particular embodiment consist of two rectangular stitches (8) and (10) sewn just inside the edges of the overlapped section (7) of the strap. The rectangular stitch (10) sewn just inside the rectangular stitch (8). This sewing pattern will leave an area in the center of the overlapped section (7) through which two mounting holes will later be drilled for attaching the dock cleat without cutting through the stitches (8) and (10). Also, the overlapped section (7) of the strap (1) provides a stronger mounting surface to which the dock cleat will be bolted. Once the step has been completed to sew the overlapped section (7) of the strap together and thereby attach it to the cam-lock buckle (4), the overall length of the strap (1) is now 46¾".

Figure 4:
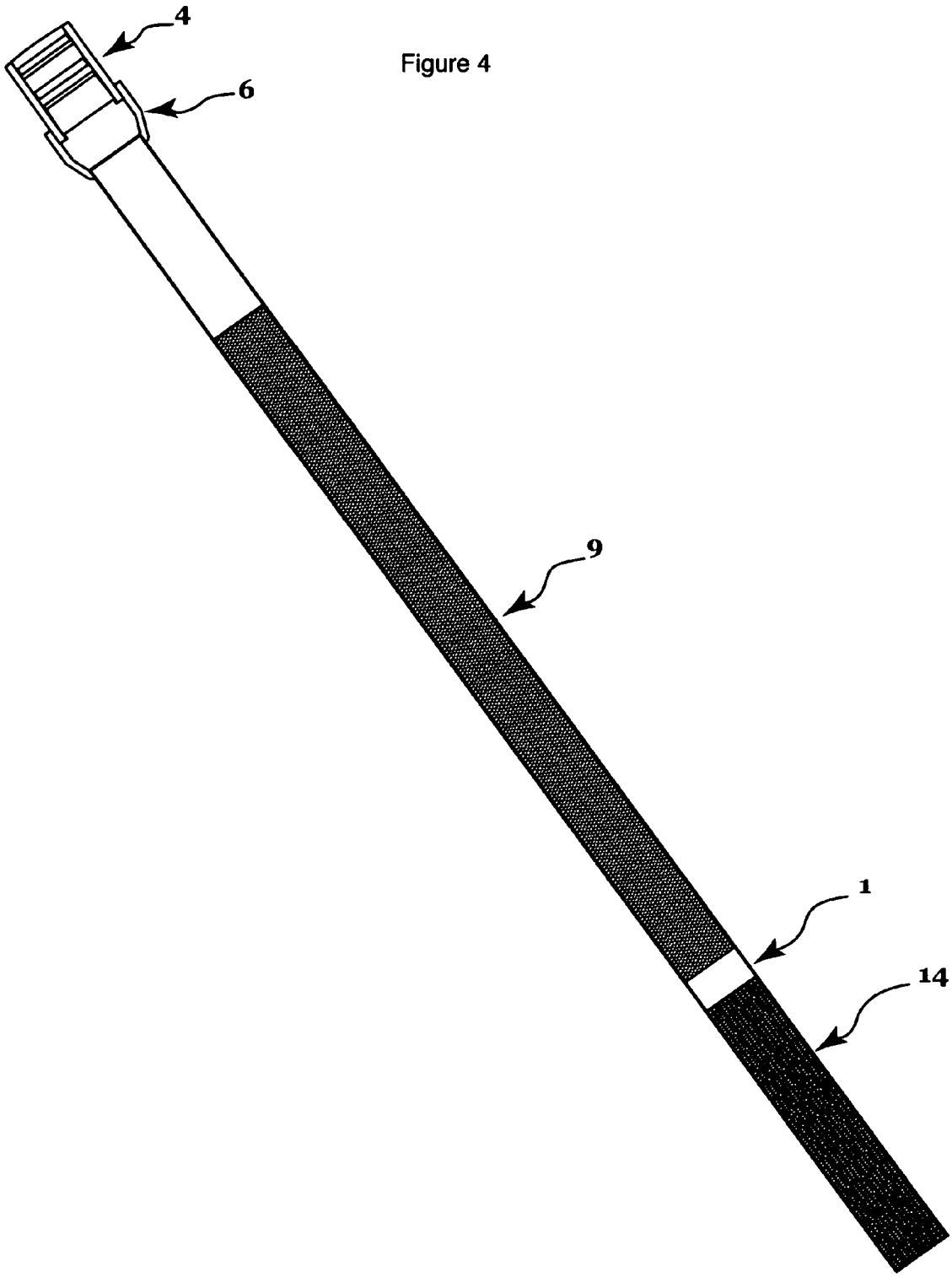
FIG. 4 similar to FIG. 3, illustrates the device under construction with the open cam-lock buckle and strap extended it's full length. This figure depicts the entire length of what would be the outside or exposed side of the strap when it is secured around a dock piling for use. The placement of both components of the Velcro material are also illustrated.

Both components of the Velcro material should now be sewn onto the strap using nylon thread. The exact length and location of the Velcro material as it is placed on the strap is important to maximize the circumference range of dock pilings around which the portable dock cleat may be wrapped and the loose end of the strap then secured by the Velcro. Both components of the Velcro material are sewn onto the side of the strap opposite the side that the strap was earlier overlapped to secure the cam-lock buckle. The loop component of the Velcro material is 2" wide and is cut to a length of 27". The hook component of the Velcro material is 2" wide and is cut to a length of 11". Referring to FIG. 4, the loop Velcro material (9) is now positioned onto the strap (1) lengthwise with one end of the loop Velcro material (9) positioned 6½" from the point where the strap (1) wraps around the inside radius of the steel connector bar (6) of the cam-lock buckle (4). To prepare for sewing, the loop Velcro material (9) may be pinned to the strap (1) or held in position by hand. The strap (1) and loop Velcro material (9) may be sewn together from either side of the strap (1). FIG. 3 illustrates the strap (1) from the opposite side that the loop Velcro material (9) is sewn onto, in order to show the sewing pattern that is used. The loop Velcro material (9) is sewn to the strap (1) using two rectangular stitches (11) and (12) sewn just inside the edges of the loop Velcro material (9). The rectangular stitch (12) just inside the rectangular stitch (11)

Referring to FIG. 4, the hook Velcro material (14) is now positioned lengthwise onto the strap (1) on the same side as the loop Velcro material (9). The hook Velcro material (14) has one end positioned flush with the loose end of the strap (1). To prepare for sewing, the hook Velcro material (14) may be pinned to the strap (1) or held in position by hand. The strap (1) and hook Velcro material (14) may be sewn together from either side of the strap (1). FIG. 3 shows the strap (1) from the opposite side that both the loop Velcro material (9) and hook Velcro material (14) are sewn onto, in order to illustrate the sewing pattern that is used. The hook Velcro material (14) is sewn to the strap (1) using two rectangular stitches (13) and (16) just inside the edges of the hook Velcro material (14). The rectangular stitch (16) just inside the rectangular stitch (13).

Figure 5:
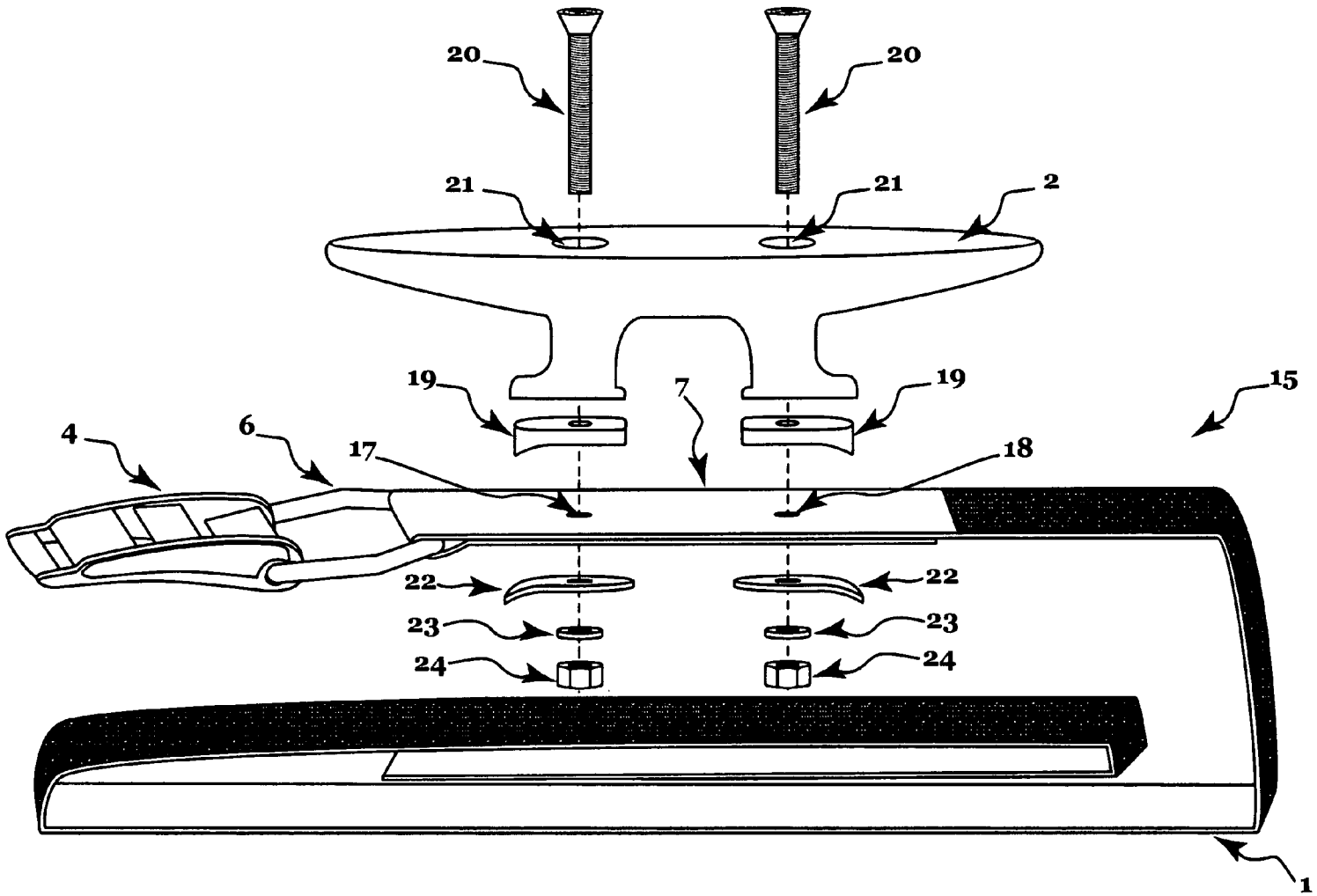
FIG. 5 depicts an exploded view of the components that are used to secure the dock cleat to the strap.

Referring to FIG. 5, the strap (1) can now be prepared to mount a conventional 8" open base dock cleat (2). The dock cleat must be mounted on the overlapped section (7) of the strap (1) near the cam-lock buckle (4). This location allows for the dock cleat to be mounted on the strongest part of the strap as well as allowing the portable dock cleat (15) to be installed around the widest variation of dock piling circumferences.

Referring again to FIG. 5, the holes (17) and (18) for mounting the dock cleat (2) are drilled through the strap (1) using a 3/16" drill bit. Both holes (17) and (18) are drilled on center line of the 2" width of the strap (1) and may be drilled from either side of the strap. Hole (17) is drilled nearest the cam-lock buckle (4) spaced 2⅜" on center as measured from the point that the strap (1) wraps around the inside radius of the steel connector bar (6) of the cam-lock buckle (4). Hole (18) is then drilled 2¼" on center from hole (17). With the holes now drilled, the dock cleat (2) can be bolted to the strap (1) on the side of the strap opposite of the side on which the strap was overlapped (7). The exploded view of FIG. 5 shows contoured nylon washers (19) that match the footprints of the dock cleat (2) should be placed between the feet of the dock cleat (2) and the strap (1) with the flat side of the contoured nylon washers (19) facing the feet of the dock cleat (2). Next is the insertion of the two ¼"×20×2¼" bolts (20) through the mounting holes (21) on top of the dock cleat (2) and through the contoured nylon washers (19) and strap (1). Two ⅜"×1½" washers (22) that have been bent to conform to the approximate radius of a dock piling are then installed over the threaded end on the bolts (20) to provide a hard surface for two locking washers (23) to contact and to provide a support surface to spread stress over a broad surface of the strap (1) when it is pulled tightly around the circumference of a dock piling. The two ¼" locking washers (23) are then installed over the threaded end of the bolts (20) followed by two 12×24 hex nuts (24). These hex nuts (24) are now tightened onto the bolts (20) to secure the dock cleat (2) to the strap (1).

Figure 6:
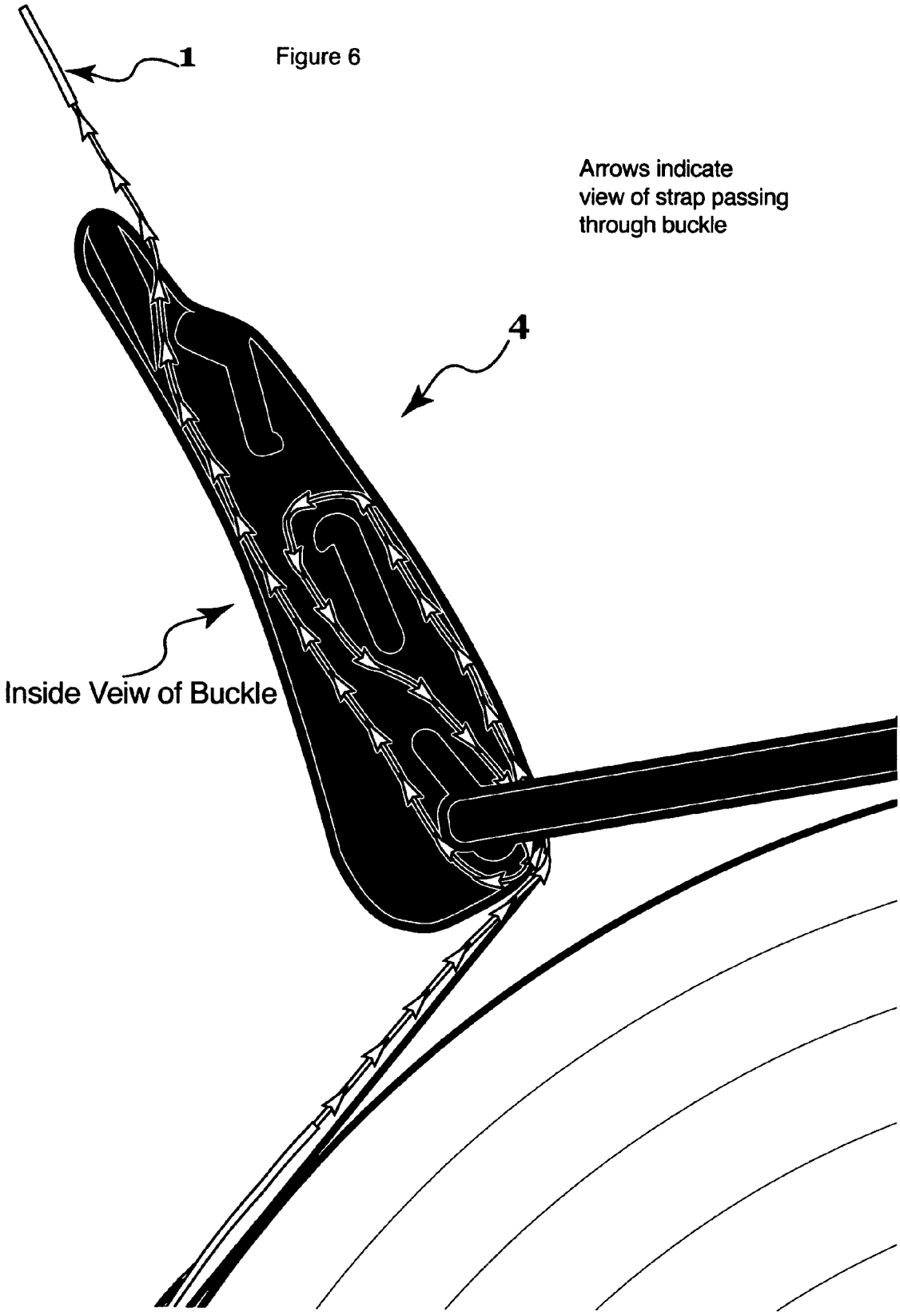
FIG. 6 depicts a view inside the frame of the cam-lock buckle, illustrating how the loose end of the strap is inserted through the buckle for proper operation and closure.

With the dock cleat (2) secured to the strap (1), the construction of the portable dock cleat (15) is now complete and the device is ready for use. When the boat operator has determined the best location for the portable dock cleat, the unbuckled strap may now be placed around the chosen dock piling. Referring to FIG. 6, with the strap (1) around the piling, the loose end of the strap is now threaded through the cam-lock buckle (4) as illustrated. Now referring to FIG. 7, while the strap (1) remains loose around the circumference of the dock piling (5) the cam-lock buckle (4) is oriented in the open position, placing it on a 90 degree plane from the adjacent surface of the dock piling (5). The loose end of the strap (1) is now pulled outward at a 90 degree angle away from the adjacent surface of the dock piling (5) tightening it around the piling and removing most of the slack in the strap (1). The loose end of the strap (1) is now pulled back toward the surface of the dock piling (5). This motion will cause the cam-lock buckle (4) to rotate around the point of it's profile (25) further tightening the strap (1) around the piling (5) and locking the cam-lock buckle (4) into a closed and secure position.

The loose end of the strap (1) is now pressed down onto the adjacent section of it's surface as it encircles the dock piling (5) causing the loop (9) and hook (14) Velcro components to engage. This further secures the portable dock cleat (15) to the dock piling (5). An appropriate size and length of dock line may now be secured around the dock cleat (2) in a conventional fashion with the other end of the dock line secured to the boat.

Figure 7:
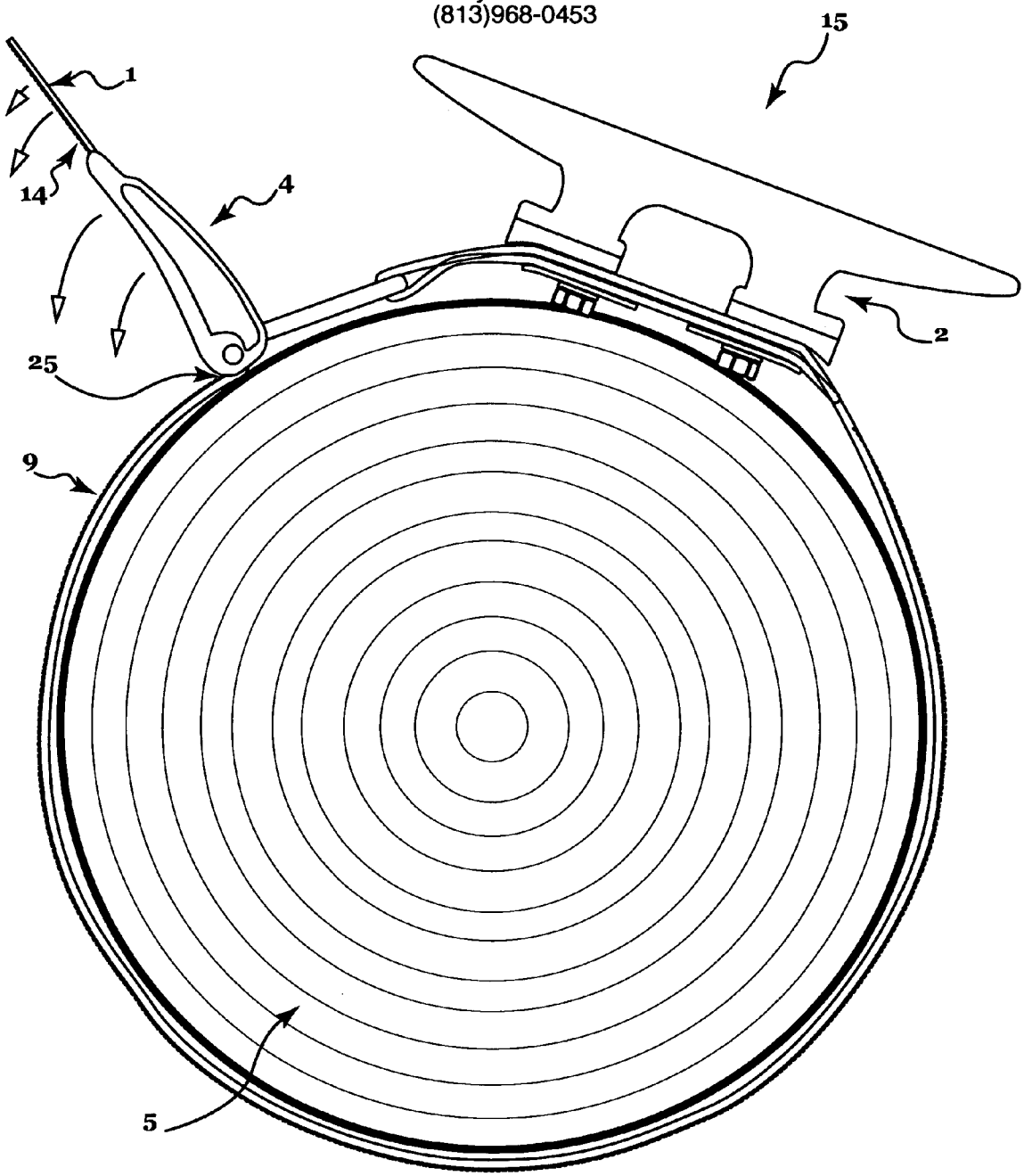
FIG. 7 illustrates a view from above the point of attachment as the portable dock cleat is wrapped around a dock piling and the cam-lock buckle is in the open or unlocked position. The loose end of the strap is threaded through the cam-lock buckle and the buckle is ready to be rotated around the point of it's profile to lock down against the dock piling.
Figure 8:
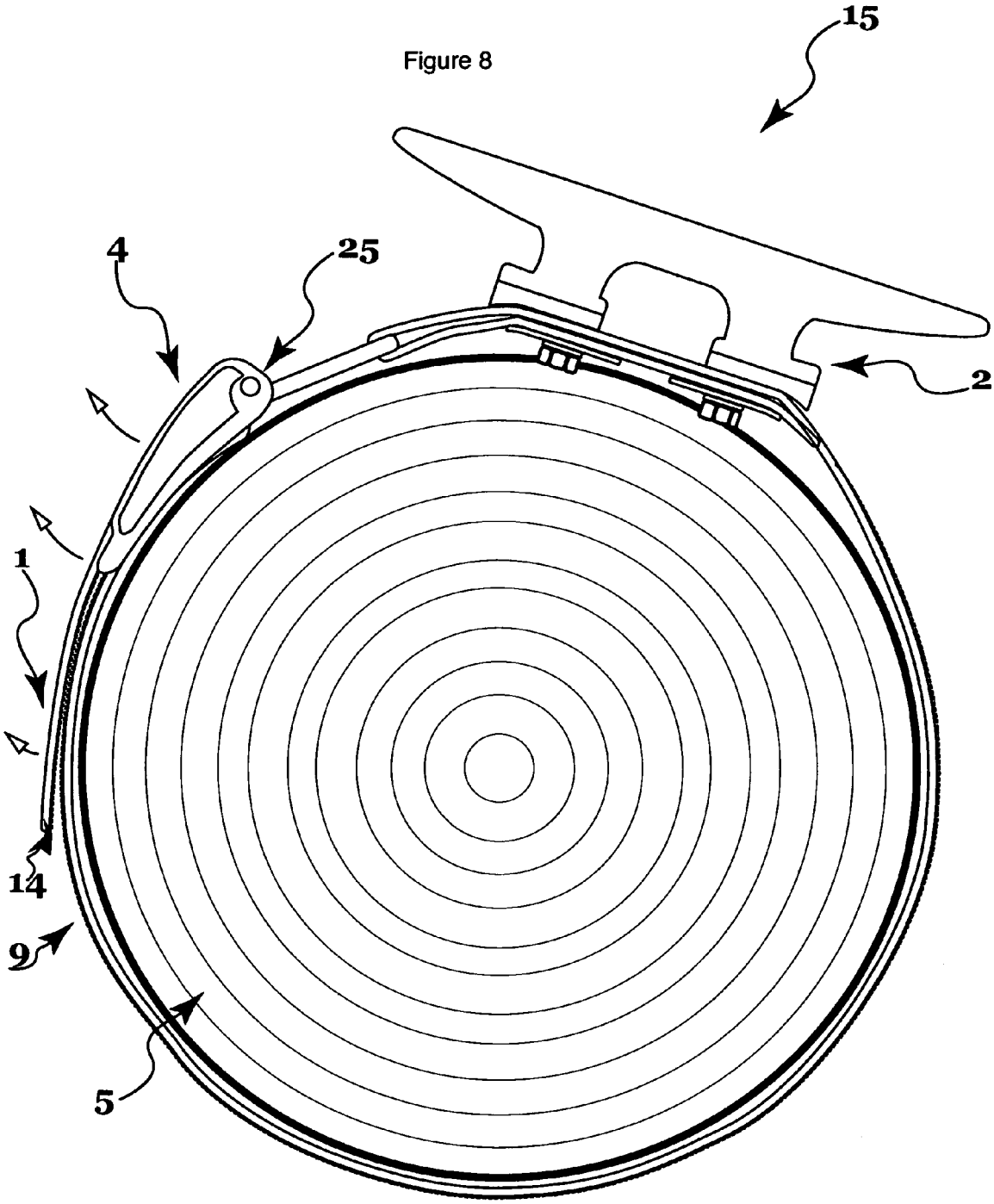
FIG. 8 shows a view from above the point of attachment as the portable dock cleat is properly installed on a dock piling with the cam-lock buckle closed and locked, and the end of the strap held down by Velcro.

To remove the portable dock cleat, refer to FIG. 8 and reverse the motions that were used to install it in FIG. 7. The loose end of the strap (1) is pulled away from the dock piling (5) causing the loop (9) and hook (14) Velcro components to disengage. The loose end of the strap (1) is now pulled farther away from the dock piling (5) onto a 90 degree plane from the adjacent surface of the dock piling, causing the cam-lock buckle (4) to rotate in an opposite direction around the point of it's profile (25) and snap into an open position.

The strap (1) is now unthreaded from the cam-lock buckle (4) and the portable dock cleat (15) may now be removed from the dock piling (5). In it's current embodiment, the portable dock cleat may also be installed around tree trunks, tree limbs or any other secure object that has a suitable circumference and location for securing a boat. While this invention as described is used specifically for securing a boat to a dock, wharf, pier or other secure structure, it may be used to secure any number of objects to a fixed structure that has a suitable circumference around which the portable dock cleat may be wrapped and secured by the cam-lock buckle and Velcro. As such this application is intended to cover any variations, uses, or adaptations of the invention that may be developed both in and out of the recreational and commercial boating environment.

What we claim is:

1. A portable dock cleat assembly comprising;

a flexible strap having an inside surface, outside surface and two ends, the strap being of such length that it can be snugly wrapped and secured around a dock piling of varying but typical circumferences;

a cam-lock buckle attached to one end of said strap, the concave surface of the buckles profile being on the same side as the inside surface of the strap, the cam-lock buckle serving to tighten the strap and securing the loose end of the strap as the strap is wrapped around the circumference of a dock piling;

a hook and loop fastener system attached to the outside surface of said strap, allowing for the cam-lock buckle to be further secured in it's closed position by securing the loose end of the strap onto itself against the outside surface of the strap;

a dock cleat with two holes oriented from top to bottom that align with two holes located in the strap, said holes to accept two bolts to secure the dock cleat to the outside surface of said strap, locating the dock cleat in a position to receive and secure a docking line from a boat when the strap is wrapped and secured around a dock piling.

2. A portable dock cleat assembly as recited in claim 1, wherein the cam-lock buckle has a steel connector bar for connection to one end of said strap;

the strap being attached to the cam-lock buckle by pulling the strap around the inside radius of the steel connector bar, said strap being pulled further through the steel connector bar and overlapped onto itself to be secured in that position by means of sewing.

3. A portable dock cleat assembly comprising;

a flexible strap having an inside surface, outside surface and two ends, the strap being of such length that can be snugly wrapped and secured around a dock piling of varying but typical circumferences;

a cam-lock buckle attached to one end of said strap, the concave surface of the buckles profile being on the same side as the inside surface of the strap, the cam-lock buckle serving to tighten the strap and securing the loose end of the strap as the strap is wrapped around the circumference of a dock piling;

a hook and loop fastener system comprising the hook component of the hook and loop material being attached by means of sewing to the outside surface of said strap at the end of the strap opposite the end to which the cam-lock buckle is attached;

the loop component of the hook and loop material being attached by means of sewing to the outside surface of said strap in such a length and position on the strap, as to allow for the maximum range of dock piling circumference around which the hook and loop components can make contact and attachment when said strap is wrapped around a dock piling, pulled through the cam-lock buckle, and the loose end of the strap is then further secured by closing the cam-lock buckle and pressing the loose end of the strap down onto it's outside surface;

a dock cleat with two holes oriented from top to bottom that align with two holes located in the strap, said holes to accept two bolts to secure the dock cleat to the outside surface of said strap, locating the dock cleat in a position to receive and secure a docking line from a boat when the strap is wrapped and secured around a dock piling.

4. A portable dock cleat assembly as recited in claim 3, wherein a dock cleat is mounted to the outside surface of the strap in the location where the strap is overlapped, this location of the dock cleat upon the overlapped section of the strap provides additional strength for mounting the dock cleat to the strap;

two spacing washers, one side of each washer having a flat side and the other side of each washer having a concave profile, the two spacing washers placed between the dock cleat and strap in such an orientation that the flat side of the spacing washers support the flat base of the dock cleat and the concave side of the spacing washers contact the outside surface of the strap, as said strap curves around the radius of a dock piling.

5. A portable dock cleat assembly as recited in claim 4, wherein two bolts for securing the dock cleat to the strap are inserted threaded end first, through the top of the two holes on the dock cleat, downward through the two spacing washers and through the two holes in the strap, the threaded end of the two bolts thus protruding through and beyond the inside surface of the strap.

6. A portable dock cleat assembly as recited in claim 5, wherein two spacing washers with a curved profile are installed on the threaded end of the two bolts, the curvature of the spacing washers being oriented such that the convex side of the washers are contacting the inside surface of the strap as said strap curves around the radius of a dock piling.

7. A portable dock cleat assembly as recited in claim 6, wherein two lock washers, followed by two hex nuts are installed on the threaded end of the two bolts, said hex nuts then tightened on the bolt threads to secure the dock cleat to the strap.

* * * * *